US006001524A

United States Patent [19]

Yoon et al.

[11] Patent Number: 6,001,524

[45] Date of Patent: Dec. 14, 1999

[54] TONER PARTICLES FOR ELECTROPHOTOGRAPHIC IMAGING APPLICATIONS

[75] Inventors: Hyun-Nam Yoon, New Providence; Eui Won Choe, Randolph; Anthony J. East, Madison; Tze-Pei Tien, Basking Ridge, all of N.J.

[73] Assignee: HNA Holdings, Inc., Warren, N.J.

[21] Appl. No.: 09/044,770

[22] Filed: Mar. 19, 1998

[51] Int. Cl.[6] ..... G03G 9/087; G03G 9/09

[52] U.S. Cl. ..... 430/106; 430/109; 430/137

[58] Field of Search ..... 430/106, 109, 430/137

[56] References Cited

U.S. PATENT DOCUMENTS

| | | | |
|---|---|---|---|
| 2,297,691 | 10/1942 | Carlson | 430/31 |
| 4,645,727 | 2/1987 | Ong et al. | 430/106 |
| 4,778,742 | 10/1988 | Ong et al. | 430/106 |
| 4,933,252 | 6/1990 | Nishikawa et al. | 430/109 |
| 4,940,644 | 7/1990 | Matsubara et al. | 430/109 |
| 5,066,558 | 11/1991 | Hikake et al. | 430/109 |
| 5,102,761 | 4/1992 | Ohsaki et al. | 430/106 |
| 5,149,610 | 9/1992 | Kobayashi et al. | 430/106 |
| 5,200,290 | 4/1993 | Ong et al. | 430/115 |
| 5,219,697 | 6/1993 | Mori et al. | 430/110 |
| 5,288,577 | 2/1994 | Yamaguchi et al. | 430/106.6 |
| 5,296,325 | 3/1994 | Ohtsuke et al. | 430/106 |
| 5,348,832 | 9/1994 | Sacripante et al. | 430/109 |
| 5,352,521 | 10/1994 | Hotta et al. | 428/402 |
| 5,424,161 | 6/1995 | Hayashi et al. | 430/110 |
| 5,434,030 | 7/1995 | Smith et al. | 430/106 |
| 5,437,953 | 8/1995 | Russell et al. | 430/106 |
| 5,460,914 | 10/1995 | Sasaki et al. | 430/109 |
| 5,470,687 | 11/1995 | Mayama et al. | 430/137 |
| 5,500,321 | 3/1996 | Kasuya et al. | 430/109 |
| 5,565,298 | 10/1996 | Suguro et al. | 430/137 |
| 5,691,095 | 11/1997 | Shinzo et al. | 430/106 |
| 5,843,609 | 12/1998 | Borzo et al. | 430/106 |

*Primary Examiner*—Roland Martin
*Attorney, Agent, or Firm*—James A. Jubinsky

[57] ABSTRACT

In one embodiment, this invention discloses polyester-based toner particles suitable to be dyed directly and coated with charge control agent and flow agent to result in particles suitable for color toner applications. The particles have ideal particle size, shape and distribution for such applications.

55 Claims, No Drawings

TONER PARTICLES FOR ELECTROPHOTOGRAPHIC IMAGING APPLICATIONS

FIELD OF THE INVENTION

This invention discloses toner particles for color electrophotographic imaging applications. The particles are based on substantially amorphous polyesters which contain functionalities that are capable of being reacted with coloring reagents to form dyed polyester particles, which after further treatment are incorporated into toner compositions. The present invention is related to those disclosed in pending co-owned patent applications, Ser. No. 08/923,391, now U.S. Pat. No. 5,843,609, and 08/923,394, both filed on Sep. 3, 1997, disclosures of which are incorporated herein by reference.

BACKGROUND OF THE INVENTION

The formation and development of images on the surface of photoconductive materials by electrostatic means is well known. The basic electrophotographic imaging process (U.S. Pat. No. 2,297,691) involves placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic toner material. The toner will normally be attracted to those areas of the photoreceptor which retain a charge, thereby forming a toner image corresponding to the electrostatic latent image. This developed image may then be transferred to a substrate such as paper. The transferred image subsequently may be permanently affixed to the substrate by heat, pressure, a combination of heat and pressure, or other suitable fixing means such as solvent or overcoating treatment.

Also well known are techniques to develop such electrostatic images. Developer is a vehicle in which are dispersed charged colored toner particles. The photoreceptor bearing the electrostatic latent image is contacted with the developer. The contact causes the charged toner particles in the developer to migrate to the charged areas of the photoreceptor to develop the latent image. Then, the photoreceptor with the charged colored particles adhering to the latent image in image configuration. The developed image is then typically transferred to a suitable substrate, such as paper or transparency material, and optionally may be fixed to the substrate by heat, pressure or other suitable means.

Toners and developer compositions including colored particles are well known. Some U.S. Pat. Nos. in this regard are 5,352,521; 4,778,742; 5,470,687; 5,500,321;,5,102,761; 4,645,727; 5,437,953; 5,296,325; and 5,200,290. The traditional compositions normally contain toner particles consisting of resin and colorants, wax or a polyolefin, charge control agents, flow agents and other additives. A typical toner formulation generally contains about 90–95 weight percent resin, about 2–10 weight percent colorant, 0–about 6 weight percent wax, 0–about 3 weight percent charge control agent, about 0.25–1 weight percent flow agent and 0–about 1 weight percent other additives. Major resins are styrene-acrylic copolymers, styrene-butadiene copolymers and polyesters. The colorants usually are selected from cyan dyes or pigments, magenta dyes or pigments, yellow dyes or pigments, black dyes or pigments, and mixtures thereof.

One of the main advantages of selecting organic dyes instead of pigments for color toner compositions resides in the provisions of increased color fidelity as the dyes can be molecularly dispersed in the toner resins. To obtain a homogeneous dispersion, it is generally necessary to build into these molecules certain substituents for enhancing their compatibility with the toner resin. Unless the dye molecules are substantially fully compatible with the toner resins, they have a tendency to aggregate with time, especially when subjected to heat, pressure and humidity thereby resulting in a loss of color fidelity. Additionally, the low molecular weight of the dye molecules causes a high lability or mobility of the dye molecules in the toner resin resulting in undesirable bleeding of the dyes.

Conventional color toners are produced by a milling process described, for example, in the afore-mentioned U.S. Pat. No. 5,102,761. In that process, a polyester resin is compounded with pigments, charge control agents ("CCA") and occasionally wax in a melt mixer. The resulting polymer mixture is mechanically crushed and then milled into small particles. The conventional toner particles typically have an irregular shape and a broad distribution in particle size. For optimum resolution of images and color, smaller particles perform better. Thus, for example, it is difficult to obtain resolutions better than about 400 dots/inch when the average particle size is more than about 7 $\mu$m. For resolutions in the order of about 1200 dots/inch, particle sizes smaller than 5 $\mu$m are typically needed. It is difficult to make particles smaller than about 7–10 $\mu$m by conventional processes because of the high energy cost of producing small particles as well as uniform narrow particle size distribution.

Improvements to cure such efficiencies have been attempted in the past. For example, the afore-mentioned U.S. Pat. No. 5,352,521, 5,470,687 and 5,500,321 disclose toner particles produced by dispersion polymerization. In such method, monomers (typically styrenic and acrylate monomers) and additives such as pigments, CCA and wax are mixed together to form a dispersion. This is then further dispersed into an aqueous or a non-aqueous medium and the monomers are reacted to form toner particles. These particles, however, are deficient in uniform distribution of colorants, the transparency of the images as well as having a high cost. Furthermore, these processes are not useful to prepare polyester-based toner particles which are preferred over the styrenics or the acrylics due to their superior compatibility with pigments.

Pending applications 08/923,391, now U.S. Pat. No. 5,843,609, and 08/923,394 disclose polyesters and polyester-based toner particles which contain dye moieties in the backbone of main chain polyester repeat units.

There is continuing interest in the development of new and improved toner compositions for application in electrophotography.

Accordingly, it is an object of this invention to provide a polyester-based toner composition which has a superior combination of properties for electrophotographic imaging systems.

Other objects and advantages of the present invention shall become apparent from the accompanying description and examples.

SUMMARY OF THE INVENTION

One or more objects of the present invention are accomplished by the provision of resin particles suitable for color toner applications and comprising a substantially amorphous, substantially colorless main chain polyester. The polyester comprises, in the range 1–10 mole percent of its repeat unit, functionalities suitable to be converted to dyes by chemical reaction with suitable coloring reagents by ionic or covalent bonding. The polyester possesses a glass transition temperature (Tg) in the range 40–80° C. and number average molecular weight in the range 1500–20000, and the particles are substantially spherical in shape having a volume average diameter in the range 1–10 μm, with at least 95 percent of the particles having a number average diameter in the range 2–15 μm. The terms "volume average diameter" and "number average diameter" are defined in, for example, *Powder Technology Handbook*, 2nd edition, by K. Gotoh et al, Marcell Dekker Publications (1997), pages 3–13. The polyesters suitable to be converted to the desired substantially spherical shaped toner particles have repeat units of the general formula:

$$-[P^1]_a-[P^2]_b-[P^3]_c-[P^4]_d-$$

where $P^1$ is a monomer moiety representing residues of a dicarboxylic acid moiety, $P^2$ is a monomer moiety representing residues of a diol moiety, $P^3$ is a monomer moiety representing residues of a hydroxycarboxylic acid moiety, and $P^4$ is a monomer moiety carrying functionalities that are suitable to be converted to dyes as stated above. The units a, b, c and d represent mole percent of the respective monomeric moiety, with a and b being independently in the range 20–49.5 mole percent, c equaling 0–99 mole percent and d equaling 1–10 mole percent. $P^1$, $P^2$, $P^3$ and $P^4$ are described below.

The inventive polyesters may be prepared by several conventional methods; however, the preferred method is a dispersion process, particularly the non-aqueous dispersion ("NAD") process. The NAD process, especially when it is performed with the right choice of reagents and reactants surprisingly yields substantially spherical particles with the desired size and distribution. The inventive polyesters possess high amorphousness and optimum Tg properties suitable to prepare a highly improved toner resin. The polyester resin particles are themselves substantially spherical in nature, the spheres being less than 10 μm in volume average diameter. Furthermore, the particles are colorless and possess narrow particle size distribution. Since they contain reactive functionalities attached to the polymer repeat unit, they are suitable to be dyed directly with suitable dyeing agents to yield dyed polyester resin particles suitable for toner applications. Such a dyeing process may be by a covalent bonding process by chemically reacting the functionalities with suitable dye molecules, or it may be an ionic complexing of the functionalities with the dyeing agent. The thus prepared dyed polyester particles may be combined suitably with charge control agent, flow agent and other desired additives in order to make toner composition.

Since the particle size of the toner particles is fixed by the instant polyester composition and the polymerization process, the instant invention results in toner particles which are substantially spherical in shape with particle sizes that are uniform and having volume average diameters under 10 μm with uniformly distributed dye groups and with uniformly coated charge control agent on the particles. This results in substantially improved toner compositions.

DESCRIPTION OF THE INVENTION

In one embodiment, the present invention discloses toner particles that are substantially uniformly spherical in shape with particle sizes under 10 μm in diameter, narrow particle size distribution, uniformly present dye moieties, charge control agent and flow agent. The inventive toner particles comprise polyester. The polyester is a main chain polyester, comprising in its repeat unit, reactive functionalities in about 1–10 mole percent amounts. The reactive functionalities are chosen as to be reactive toward suitable dyeing reagents either by a covalent bonding or by ionic complexing mechanism. The polyesters suitable to be converted to the desired substantially spherical shaped toner particles have repeat units of the general formula:

$$-[P^1]_a-[P^2]_b-[P^3]_c-[P^4]_d-$$

where $P^1$ is a monomer moiety representing residues of a dicarboxylic acid moiety, $P^2$ is a monomer moiety representing residues of a diol moiety, $P^3$ is a monomer moiety representing residues of a hydroxycarboxylic acid moiety, and $P^4$ is a monomer moiety carrying functionalities that are suitable to be converted to dyes as stated above. The units a, b, c and d represent mole percent of the respective monomeric moiety, with a and b are independently equal to 20–49.5 mole percent, c equals 0–99 mole percent and d equals 1–10 mole percent.

The dicarboxyl component forming $P^1$ is selected from a variety of sources such as, for example, carboxylic acids, acid chlorides, esters and the like, as is well known to those skilled in the art. Examples of such dicarboxylic moieties suitable for $P^1$ include, but are not limited to, terephthalic acid, isophthalic acid, fumaric acid, succinic acid, glutaric acid, adipic acid, sebacic acid, cyclohexane dicarboxylic acid, naphthalene dicarboxylic acid, 1,2-bis(4-carboxyphenoxy)ethane, and combinations thereof. The diol component forming the $P^2$ part of the polyester is selected from a variety of diol sources. Examples of suitable diol moieties include, but are not limited to, ethylene glycol, isomers of propylene glycol, isomers of butylene glycol, isomers of pentane diol, isomers of hexane diol, isomers of cyclohexane dimethanol, 2-methyl-1,3-propanediol, neopentyl glycol, bisphenol A-ethylene oxide condensate, bisphenol A-propylene oxide condensate and combinations thereof.

The hydroxycarboxylic acid component $P^3$ is derived from monomers derived from, for example, glycollic acid, lactic acid, ε-caprolactone, γ-butyrolactone, δ-butyrolactone, propiolactone, hydroxypivalic acid, lactone of hydroxypivalic acid, and combinations thereof.

The monomer unit $P^4$ which carries functionalities is a monomer which is capable of reacting with the other monomers to form a polyester and therefore may be a dicarboxylic acid moiety or a diol moiety or a hydroxycarboxylic acid moiety, wherein the functionality to later react with a coloring agent is covalently bonded. If it is a diol, for example, the mole percent of the other diol component $P^2$ is adjusted so that the total diol mole percent from $P^2$ and $P^4$ will equal that of $P^1$. Conversely, if $P^4$ is a dicarboxylic moiety carrying the functionalities, then the mole percent of the other dicarboxylic acid moiety $P^1$ is suitably adjusted such that the total dicarboxylate from $P^1$ and $P^4$ is equal to the diol component $P^2$. Similarly, when $P^4$ is a hydroxylic carboxylic acid moiety, the amount of $P^3$ is adjusted correspondingly. Thus, $P^4$ may be represented by the following three types of repeat units:

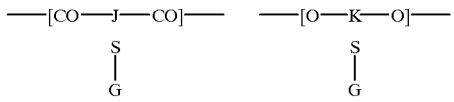

-continued

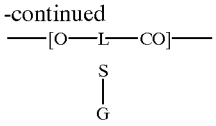

where J, K and L may be the same or different and are alkyl or cycloalkyl groups, with the functional group G attached to the group J, K or L, either directly or optionally through a suitable spacer group, S. The spacer groups may be, for example, alkyl or cycloalkyl. G is the functionality that later reacts with the coloring reagent to form a covalent bond or ionic linkage to form a dye. Examples of G include, but are not limited to, the moieties hydroxyl, alkoxy, sulfonic or derivatized sulfonic, sulfinic or derivatized sulfinic, carboxyl or derivatized carboxyl, phosphonic or derivatized phosphonic, phosphinic or derivatized phosphinic, thiol, amine, alkylamine and quaternized amine and combinations thereof, e.g., —$SO_3M$, O—COOM, —P(=O)$(OM)_2$, —P(=O)R(OM), —OH, —OR, —$NR_1R_2R_3^+A^-$, —NHR and —SH, where R, $R_1$, $R_2$ and $R_3$ are alkyl groups, M is a metal group and $A^-$ is an anion.

The desired polyesters of suitable particle shape and size may be prepared from the above-noted components by a variety of techniques. Preferred method is a dispersion process. The most preferred method to prepare them is the non-aqueous dispersion ("NAD") polymerization process. Generally in the NAD process, a polymerizable monomer, a catalyst and stabilizer are dispersed in an organic solvent thereby initiating the polymerization, and the polymer particles insoluble in the organic solvent are made to grow with coalescence the oligomer produced in the first stage of the polymerization as the particle cores. While NAD is a known process to prepare spherical particles with uniform distribution, it is generally used for styrenes and similar monomers. The afore-mentioned U.S. Pat. No. 5,352,521 discloses that dispersion polymerization, as a technique to prepare polymers, is not much useful for preparing polyesters owing to the high cost involved. Applicants, however, have surprisingly found NAD to be a useful method to prepare polyester particles of suitable size and shape useful for toner applications from the above-described monomeric components. This has been accomplished by proper choice of the reagents and conditions for the NAD polymerization reaction. A typical NAD polymerization reaction with the monomers dimethyl terephthalate for $P^1$, a mixture of ethylene glycol and 2-methylpropan-1,3-diol for $P^2$ and dimethyl 5-sulfoisophthalate sodium salt for $P^4$ (G being the sulfonate group) is described below and in the EXAMPLES section.

Since the sulfoisophthalate contains a dicarboxylic moiety, the amount of dimethyl terephthalate is suitably adjusted to fit stoichiometry in the polyester preparation. The mixture of the monomers is taken along with a suitable catalyst such as, for example, dibutyl tin oxide in a suitable vessel in an inert atmosphere and heated to a temperature suitable enough to distil off the solvents and result in a prepolymer mix. This prepolymer mix is mixed with a solvent such an aliphatic hydrocarbon oil which helps in further heating to remove all distillates. This mixture is heated to a temperature to remove all volatiles off. It is then cooled and the polyester particles are isolated. This process surprisingly results in spherical particles with particle size in the range 1–10 $\mu$m with no need to resort to mechanical crushing and the like.

The advantage of these polyester particles is that they can be directly dyed by appropriately reacting the functionalities (G) on the polyester with appropriate coloring reagents. The coloring reagent is typically a dye which may be a basic dye, acid dye, reactive dye and combinations thereof. Basic dyes are cationic molecules which ionically bind to anionic sites. Acid dyes are anionic molecules which bind to cationic or basic sites, while reactive dyes are functional molecules which contain groups that covalently bind to sites such as, for example, —OH, —SH or —NRH in order to form respectively an ether, thioether or amine linkages. Suitable dyes may be basic dyes, acid dyes or reactive dyes. Illustrative basic dyes may be, for example, the azo, monoazo or diazo dyes (such as the commercially available Basic Yellow 39, 73, 74, 26, 27, 28, 29, 30, 55, 15, 17, 19, 25, 26, 27, 30, 32, 67, 42, 41, 80, 82, 77; Basic Blue 76, 53, 54, 93, 128, 129, 149, 146, 117, 118, 128, 129, 131, 132, 133, 135, 136, 137, 162; BasicViolet: 18, 19, 30, 32, 33, 37, 42, 41; and Basic Red: 25, 29, 46, 70, 67, 69, 22, 23, 24, 17, 18, 100, 101, 102, 103, 104,38, 39, 94, 54, 55, 56,59,82, 86, 107, 72, 73, 74; or the azomethine dyes (such as, for example, the commercially available Basic Yellow 72,24,45; Basic Red 45; the azine dye such as the commercially available Basic Violet 17; the anthraquinone dye such as the commercially available Basic Blue: 60, 62, 45, 46, 47, 150, 115, 139, 21,22, Basic Violet: 24, 25; the oxazine dye such as the commercially available Basic Blue 3, 75,87,104, 108, 114, 141, 151; the methine dyes such as the commercially available Basic Yellow 28,29,92,93,53,63,23,87,79,21; Basic Violet 16, 27, 20, 22, 47,43, 45; Basic Red: 68, 92, 93, 96; the thiazole due such as the commercially available Basic Violet: 46, 44; and the phthalocyanine dyes such as the commercially available Basic blue 157, 152, 160, 100, 138, 140, 161. Illustrative acid dyes may be acid dyes with azo or diazo structures such as the commercially available Acid blue 193,194,113,73; acid yellow 136, 137, 166, 168, 215, 134, 220, 41, 159; acid violet 56, 91, 100, 101, 116, 115, 128, 129, 122, 88; acid red 34, 100, 120, 195, 257, 258, 404; and acid Dyes with anthraquinone structure such as the commercially available Acid red 83, acid violet 103, 109; acid blue 25, 49, 129. Illustrative reactive dyes include dyes connected to reactive group such as vinylsulfone, for example, the commercially available Reactive red 23, 107, 126, 194, 198, reactive yellow 16, 17; reactive blue 19, 20, 21, 143, 144, 223; reactive violet 4, 5, 32; and dyes connected to mono or dichlorotriazine such as reactive yellow 6, 7, 18, 80, 81, 86, 162; reactive red 9, 125, 139, 140, 231, 232; reactive violet 1, 2; reactive blue 9, 13, 39, 191; and dyes connected to mono or dichloropyrimidinyl group such as the commercially available reactive yellow 19; reactive orange 111; reactive red 9, 11; reactive violet 3; and reactive blue 8, 10. As will be obvious to those skilled in the art, the choice of the dye depends on the functional group G on the polyester.

The dyeing reaction may be performed, for example, by dispersing the polyester particles in a dye bath containing the dyeing reagent in a suitable solvent wherein covalent bonding or ionic complexing occurs, which depends on the choice of the functionalities and the dyeing agent as is well known to those skilled in the art. Generally, a catalyst is not necessary in the reaction although one may be used if so desired. In most cases, dissolving the dye, in about 1–10 weight percent, in a solvent such as, for example, water, methanol, ethanol and the like, adding the polyester particles and vigorously agitating yields the dyed particles which may be filtered off and dried. A surfactant or colloidal additive may sometimes be used to prevent agglomeration of the particles during the dyeing reaction. The surfactant may be anionic, cationic or non-ionic depending upon the functionality and coloring reagent. Thus, for example, the colorless polyester particles may be agitated with a nonionic surfactant such as, for example, the Genapol 26-L-80® brand non-ionic surfactant (which is a surfactant from C12–C16 linear alcohols and ethylene oxide, available from Clariant Corporation, Charlotte, N.C.), a yellow dye such as, for example, the Astrazon Yellow 7GLL® brand dye (which is a cationic dye of the methine type, available from DyStar Corporation, Charlotte, N.C.) in water and heated at about 5–90° C. for about 5–120 minutes to give dyed particles. The optical properties of the dyed particles may be checked by conventional methods such as, for example, optical density measurements.

For color toner applications, a charge control agent ("CCA") is typically coated on the dyed particles. Suitable charge control agents may be the negative-type or the positive-type. Several such CCAs are commercially available such as, for example, the E-88® brand CCA (a negative charge control agent which is an aluminum compound, available from Orient Chemical Corporation, Springfield, N.J.) and the Bontron P-53® brand CCA (a positive CCA, also available from Orient Chemical Corporation). The dyed polyester particles of the invention may be coated with a charge control agent with ease. Such processes as dry mixing, solvent coating, spray coating and like may be used. In a typical solvent coating process, the CCA may be dissolved or dispersed in a suitable solvent such as, for example, water, methanol, ethanol, hydrocarbons and the like, and their combinations, the dyed particles may be added and agitated and filtered to get CCA-coated dyed particles.

The CCA-coated particles may then be coated with a suitable flow agent. They generally help to enhance the flowability of the particles during their use as color toner. Suitable flow agents are materials such as fumed silica which may be applied by processes such as, for example, dry mixing, solvent mixing and the like. In a typical process, a hydrophobic fumed silica (previously treated with a surface activating reagent such as, for example, hexamethyldisilazane and available under the trade name Cab-O-Sil T-530® from Cabot Corporation, Tuscola, Ill.) is mixed with the CCA-coated particles and blended well in a tumble mixer for about 10–60 minutes to obtain flow agent-coated toner particles.

In many color toner applications, the toner particles are used as a developer which typically contains the dyed particles as described above (containing the CCA and the flow agent) and a suitable carrier agent (such as, for example, ferrites, steel, iron powder and the like, optionally containing a surface treating coating agent thereon) are mixed together intimately to form the developer. Since, for color toner applications, a combination of black, magenta, cyan and yellow colors is required, the above-described colorless polyester particles are chemically bonded to such suitable coloring reagent through the functionalities on the polyester, then coated with the CCA and flow agent and then combined suitably with a carrier by well known processes to yield a superior color toner material.

The following EXAMPLES are provided for purposes of illustration only and not by way of limitation.

EXAMPLES

Example 1

Preparation of a Cationically-Dyeable Polyester toner Polymer by NAD:

A pre-polymer was first made by reacting dimethyl terephthalate (4625 g., 23.84 moles), dimethyl 5-sulfoisophthalate (sodium salt) (218 g., 0.736 moles), ethylene glycol (2591 g., 41.79 moles) and 2-methylpropan-1,3-diol (664 g., 7.37 moles) to form a 97/3/70/30 copolymer in the presence of dibutyl tin oxide catalyst (2.5 g). The reaction was carried out in a 10-liter reaction vessel fitted with a paddle stirrer and a 20 cm fractionating column to separate the methanol evolved in the reaction. The reaction mixture was heated from 150° C. to 200° C. under an inert nitrogen atmosphere over 8 hours without applying vacuum until a total of 1534 g distillate had been collected. On cooling to room temperature, 6500 $\mu$m of a white, waxy material was obtained.

The prepolymer as described above (405.6 gm) was mixed with an aliphatic hydrocarbon oil (a 50:50 mixture of ISOPAR P® and ISOPAR L® brand saturated paraffinic hydrocarbon oils supplied by Exxon Corporation, Houston, Tex.) b.p 210° C. (300 g.), and a copolymer of 1-vinylpyrrolidinone (7.5 g.) and 1-eicosene ("Antaron 220") and then charged to a 1-liter glass reactor fitted with a turbine-type agitator and baffles. The mixture was heated from 190° C. to 205° C. over 50 minutes and then to 209° C. over 30 minutes under high-speed agitation at 1800 rpm. The reaction mixture became opaque and milky at 195° C. and the distillate which collected was largely a mixture of glycols with the aliphatic hydrocarbon oil. This distillate was collected and the oil recycled through a phase-separator device. After two hours at 209° C., the mixture was slowly cooled to room temperature with continuous agitation and the fine white powder filtered off and washed four times with isohexane to remove traces of residual oil. The yield of polymer after drying at 40° C. overnight in vacuum was 266 gm. The glass-rubber transition temperature was 57° C., and the median particle size was 4.00 microns with a 10% size of 0.71 microns and a 90% size of 6.68 microns as measured by laser light scattering. Scanning electron microscopy showed that the particles were almost all completely spherical.

The process was repeated on a larger scale in a 5-liter reaction vessel, using the prepolymer (1700 g), a 50:50 mixture of ISOPAR P® and ISOPAR L® hydrocarbon oils (total of 1500 g) with ANTARON 220® (37 g) as the dispersing agent. The mixture was agitated at 1300 rpm at 190° C. and gradually raised over time to 213° C. and held there for 75 minutes total reaction time. The weight of distillate is 220 g. The mixture was cooled with agitation as before and the product filtered when cold, washed with isohexane four times and dried at 40° C. The yield was 1425 g and the median particle size was 5.38 microns. The Tg was 59.8° C. and the polymer I.V.=0.19, as measured in o-chlorophenol at 25° C. The residual oil content was 1.9% w/w.

Example 2

A prepolymer was prepared in a similar fashion to that of Example 1 by reacting dimethyl terephthalate (753 g., 3.88 moles), dimethyl isophthalate (776 g., 4.00 moles), dimethyl 5-sulfoisophthalate (sodium salt) (35.52 g., 0.12 moles) and propan-1, 2-diol (1216 g., 16.00 moles) in the presence of dibutyl tin oxide catalyst. A portion of the prepolymer (479 g) was mixed with an equal weight of a 1/1 mixture of "Isopar P" and "Isopar L" aliphatic hydrocarbon oils and 3.76% w/w "Antaron 220" was added. The reaction mixture was agitated at 1000 rpm and the temperature raised to 190° C. and thence gradually to 208° C. over 18 hr. The mixture was then heated at 280° C. over a further 6.5 hr. to complete the polycondensation. The dispersion was milky white and is cooled to room temperature with stirring. The white powdered product was filtered, washed repeatedly with isohexane to remove residual oil, and dried at 40° C. in a vacuum oven to constant weight. The polymer had I.V.= 0.23, Tg=59.4° C. (first heating), 68.7° C. (second heating). The median particle size was 5.38 microns.

In a similar manner, the amorphous polyesters in Table 1 were prepared:

TABLE 1

| Composition | Monomer ratio | $T_g$ (° C.) | I.V. |
|---|---|---|---|
| TA/EG/NPG | 100/70/30 | 60 | 0.09 |
| TA/PD/MPD | 100/70/30 | 50 | 0.15 |
| TA/IA/MPD | 70/30/100 | 42 | 0.19 |
| TA/IA/PD | 50/50/100 | 81 | 0.25 |
| TA/IA/PD | 70/30/100 | 80 | 0.25 |
| TA/IA/NPG | 70/30/100 | 54 | 0.10 |
| TA/adipic/PD | 95/5/100 | 60 | 0.12 |
| TA/adipic/PD | 90/10/100 | 58 | 0.14 |
| TA/adipic/PD | 85/15/100 | 59 | 0.22 |
| TA/IA/adipic/PD | 63/27/10/100 | 61 | 0.25 |
| TA/fumaric/PD | 90/10/100 | 63 | 0.12 |
| TA/adipic/PD | 90/10/100 | 63 | 0.18 |

Key:
EG: ethylene glycol
PD: propan-1,2-diol
MPD: 2-methylpropan-1,3-diol
NPG: neopentylene glycol (2,2-dimethylpropan-1,3-diol)
TA: terephthalic acid
IA: isophthalic acid Example 3

Dyeing of the functional group:

A mixture containing the polyester particles (1 g), the nonionic surfactant GENAPOL 26-L-80® (0.00625 g), the dye ASTRAZON YELLOW 7GLL® (0.03 g) and water (20 g) was heated at about 65° C. for about 10 minutes, at which time the measured optical density was 1.2. The reaction was stopped and the particles were filtered off and dried.

Example 4

Coating of charge control agent:

The charge control agent E-88® (0.01 g) was dispersed in hexane (10 g) and the dyed particles (1 g) were added into the mixture and stirred well for about 15 minutes. The coated particles were filtered and dried.

Example 5

Coating of the flow agent:

The flow agent Cab-O-Sil TS-610® (0.01 g) is dispersed in hexane (10 g) and the polyester particles from Example 4 (1 g) is mixed in and stirred for about 20 minutes. The silica coated dyed particles is then filtered and dried.

What is claimed is:

1. Resin particles suitable for color toner applications and comprising a substantially amorphous, substantially colorless main chain polyester wherein said polyester comprises, in the range 1–10 mole percent of its repeat unit, functionalities suitable to be converted to dyes by chemical reaction with suitable coloring reagents by ionic or covalent bonding, further wherein said polyester possesses a glass transition temperature (Tg) in the range 40–80° C. and number average molecular weight in the range 1500–20000, and still further wherein said particles are substantially spherical in shape having a volume average diameter in the range 1–10 μm, with at least 95 percent of said particles having a diameter in the range 2–15 μm.

2. The particles of claim 1, wherein said Tg is in the range 50–70° C.

3. The particles of claim 1, wherein said Tg is in the range 55–65° C.

4. The particles of claim 1, wherein said volume average diameter is in the range 2–10 μm.

5. The particles of claim 1, wherein said volume average diameter is in the range 3–7 μm.

6. The particles of claim 1, wherein said molecular weight range is 2000–8000.

7. The particles of claim 1, wherein said molecular weight range is 2000–6000.

8. The particles of claim 1, wherein said functionalities are selected from the group consisting of hydroxyl, alkoxy, sulfonic or derivatized sulfonic, sulfinic or derivatized sulfinic, carboxyl or derivatized carboxyl, phosphonic or derivatized phosphonic, phosphinic or derivatized phosphinic, thiol, amine, alkylamine, quaternized amine and combinations thereof.

9. The particles of claim 8, wherein said functionalities are sulfonic.

10. The particles of claim 8, wherein said functionalities are amine, alkylamine or quaternized amine.

11. The particles of claim 8, wherein said functionalities are carboxyl or derivatized carboxyl.

12. The particles of claim 8, wherein said functionalities are hydroxyl or derivatized hydroxyl.

13. The particles of claim 1, wherein said repeat unit has the general formula:

$$—[P^1]_a—[P^2]_b—[P^3]_c—[P^4]_d—$$

wherein $P^1$ is a residue from a dicarboxylic acid moiety, $P^2$ is a residue from a diol moiety, $P^3$ is a residue from a derivatized or underivatized hydroxycarboxylic acid moiety and $P^4$ is a moiety carrying said functionalities, further wherein a, b, c and d represent mole percent of the respective monomers with equaling 20–49.5 mole percent, b equaling 20–49.5 mole percent, c equaling 0–99 mole percent and d equaling 1–10 mole percent.

14. The particles of claim 13, wherein said dicarboxylic moiety $P^1$ is selected from the group consisting of residues of terephthalic acid, isophthalic acid, fumaric acid, succinic acid, glutaric acid, adipic acid, sebacic acid, cyclohexane dicarboxylic acid, naphthalene dicarboxylic acid, 1,2-bis(4-carboxyphenoxy)ethane, and combinations thereof.

15. The particles of claim 14, wherein said residues are terephthalic.

16. The particles of claim 14, wherein said residues are isophthalic.

17. The particles of claim 14, wherein said residues are succinic.

18. The particles of claim 14, wherein said residues are from 1,2-bis(4-carboxyphenoxy)ethane.

19. The particles of claim 13, wherein said diol moiety $P^2$ is selected from the group consisting of residues of ethylene glycol, isomers of propylene glycol, isomers of butylene glycol, isomers of pentane diol, isomers of hexane diol, isomers of cyclohexane dimethanol, 2-methyl-1,3-propanediol, neopentyl glycol, bisphenol A-ethylene oxide condensate, bisphenol A-propylene oxide condensate and combinations thereof.

20. The particles of claim 19, wherein said residues are ethylene glycol.

21. The particles of claim 19, wherein said residues are propylene glycol isomers.

22. The particles of claim 19, wherein said residues are 2-methyl-1,3-propane diol.

23. The particles of claim 13, wherein said derivatized and underivatized hydroxycarboxylic acid moiety $P^3$ is selected from glycollic acid, lactic acid, ε-caprolactone, γ-butyrolactone, δ-butyrolactone, propiolactone, hydroxypivalic acid, lactone of hydroxypivalic acid, and combinations thereof.

24. The particles of claim 23, wherein said $P^3$ is ϵ-caprolactone.

25. The particles of claim 1, wherein said bonding is ionic.

26. The particles of claim 1, wherein said bonding is covalent.

27. The particles of claim 1, wherein said coloring reagent is a dye selected from the group consisting of basic dye, acid dye, reactive dye and combinations thereof.

28. The particles of claim 27, wherein said basic dye is a basic dye.

29. The particles of claim 28, wherein said acid dye is an acidic dye.

30. The particles of claim 29, wherein said reactive dye is reactive dye.

31. Resin particles suitable for color toner applications and comprising a substantially amorphous main chain polyester wherein said polyester comprises, in the range 1–10 mole percent of its repeat unit, dye functionalities bonded via ionic or covalent bonding to said main chain, further wherein said polyester possesses a glass transition temperature (Tg) in the range 40–80° C. and number average molecular weight in the range 1500–20000, and still further wherein said particles are substantially spherical in shape having a volume average diameter in the range 1–10 μm, with at least 95 percent of said particles having a diameter in the range 2–15 μm.

32. The particles of claim 31, wherein said polyester further comprises spacer groups between said dye functionalities and said main chain.

33. The particles of claim 32, wherein said spacer groups are selected from the group consisting of methyl, ethyl, propyl, butyl, pentyl, hexyl, cyclopentyl and cyclohexyl.

34. The particles of claim 31, further comprising a charge control agent on said dyed polyester.

35. The particles of claim 34, wherein said charge control agent is positive.

36. The particles of claim 34, wherein said charge control agent is negative.

37. The particles of claim 34, further comprising a flow agent.

38. The particles of claim 37, wherein said flow agent is fumed silica.

39. Toner particles comprising a substantially amorphous, main chain polyester wherein said polyester comprises, in its repeat unit, moieties derived from terephthalic acid and 2-methyl-1,3-propane diol residues and additionally dye functionalities in about 1–10 mole percent amounts, said particles comprising a charge control agent coated thereon and then additionally blended with a flow agent, wherein said polyester possesses glass transition temperature in the range 40–80° C. and number average molecular weight in the range 2000–8000, further wherein said particles are substantially spherical in shape having a volume average diameter in the range 1–10 μm, with at least 95 percent of said particles having a diameter in the range 2–15 μm.

40. A process to prepare a substantially amorphous, substantially colorless main chain polyester wherein said polyester comprises, in the range 1–10 mole percent of its repeat unit, functionalities suitable to be converted to dyes by chemical reaction with suitable coloring reagents by ionic or covalent bonding, further wherein said polyester possesses a glass transition temperature (Tg) in the range 40–80° C. and number average molecular weight in the range 1500–20000, and still further wherein said particles are substantially spherical in shape having a volume average diameter in the range 1–10 μm, with at least 95 percent of said particles having a diameter in the range 2–15 μm, said process comprising:

(a) preparing a mixture comprising at least one diol and at least one dicarboxylic acid and an optional catalyst in a solvent;

(b) heating said mixture to remove any volatiles and to yield a prepolymer mix; and (c) mixing said prepolymer mix with a hydrocarbon oil; and (d) heating the mixture in step (c) to remove volatiles; and (e) cooling and isolating the polyester.

41. A process of preparing dyed polyester suitable for toner applications, said process comprising:

(a) preparing a substantially amorphous, substantially colorless main chain polyester wherein said polyester comprises, in the range 1–10 mole percent of its repeat unit, functionalities suitable to be converted to dyes by chemical reaction with suitable coloring reagents by ionic or covalent bonding, further wherein said polyester possesses a glass transition temperature (Tg) in the range 40–80° C. and number average molecular weight in the range 1500–20000, and still further wherein said particles are substantially spherical in shape having a volume average diameter in the range 1–10 μm, with at least 95 percent of said particles having a diameter in the range 2–15 μm;

(b) preparing a solution of a coloring reagent in about 1 to 20 weight percent in a solvent selected from water, alcohol, ketone, ester, ether and combinations thereof;

(c) adding said polyester particles to said solution in step (b) under agitation, and agitating, after addition, for a period of 5–120 minutes to form the dyed polyester particles; and (d) filtering the dyed particles.

42. The process of claim 41, wherein said coloring reagent is selected from the group consisting of a cyan dye, a yellow dye, a magenta dye, and combinations thereof.

43. The process of claim 41, further comprising a surfactant in step (b).

44. The process of claim 42, wherein said surfactant is cationic, anionic or non-ionic.

45. The process of claim 44, wherein said cationic surfactant is a quaternary ammonium compound.

46. The process of claim 44, wherein said anionic surfactant is a sulfonate derivative or a carboxylic acid derivative.

47. The process of claim 44, wherein said non-ionic surfactant is aqueous disposable silica.

48. A process to prepare a mixture of a dyed polyester and a charge control agent suitable for toner applications, said process comprising:

(a) preparing particles of a dyed polyester comprising (I) a substantially amorphous main chain polyester, and (ii) dye functionalities bonded via ionic or covalent bonding to said main chain wherein in the range 1–10 mole percent of the repeat unit of said polyester, wherein said polyester possesses a glass transition temperature (Tg) in the range 40–80° C. and number average molecular weight in the range 1500–20000, and still further wherein said particles are substantially spherical in shape having a volume average diameter in the range 1–10 μm, with at least 95 percent of said particles having a diameter in the range 2–15 μm;

(b) preparing a suspension of a charge control agent in a solvent selected from the group consisting of water, alcohol, hydrocarbon and combinations thereof;

(c) adding said dyed polyester particles to said suspension and agitating for about 10–60 minutes; and (d) filtering said particles.

49. The process of claim 48, wherein said charge control agent is positive.

50. The process of claim 48, wherein said charge control agent is negative.

51. A process to prepare particles suitable for color toner applications, said process comprising:

(a) preparing a mixture comprising a dyed polyester and a charge control agent thereon, wherein said dyed polyester comprises (i) a substantially amorphous main chain polyester, and (ii) dye functionalities bonded via ionic or covalent bonding to said main chain in the range 1–10 mole percent of the repeat unit of said polyester, wherein said polyester possesses a glass transition temperature (Tg) in the range 40–80° C. and number average molecular weight in the range 1500–20000, and still further wherein said particles are substantially spherical in shape having a volume average diameter in the range 1–10 $\mu$m, with at least 95 percent of said particles having a diameter in the range 2–15 $\mu$m; and (b) applying a flow agent on said mixture of dyed polyester and charge control agent.

52. The process of claim 51, wherein said flow agent is fumed silica.

53. A developer comprising carrier particles and a cyan toner, a yellow toner, a magenta toner and a black toner, each of said toner comprising particles of a substantially amorphous main chain polyester whose repeat unit comprises, in the range 1–10 mole percent of said repeat unit, appropriate dye molecules covalently or ionically bonded via suitable functionalities, wherein said polyester possesses a glass transition temperature (Tg) in the range 40–80° C. and number average molecular weight in the range 1500–20000, and still further wherein said particles are substantially spherical in shape having a volume average diameter in the range 1–10 $\mu$m, with at least 95 percent of said particles having a diameter in the range 2–15 $\mu$m.

54. The developer of claim 53, wherein said carrier particles are selected from the group consisting of ferrite, steel and iron powder.

55. The carrier particles of claim 53, further comprising a surface active agent coated thereon.

* * * * *